United States Patent [19]

Kimball et al.

[11] Patent Number: 5,029,353

[45] Date of Patent: Jul. 9, 1991

[54] FITTED BED SHEET WITH HIGHLY ELASTICIZED CORNER AND MATTRESS-RETENTION POCKET

[75] Inventors: Bruce H. Kimball, Hilton Head; Thomas C. Heb; Dwight A. McKeithan, both of Orangeburg, all of S.C.

[73] Assignee: Kimlor Mills, Inc., Orangeburg, S.C.

[21] Appl. No.: 655,060

[22] Filed: Feb. 14, 1991

[51] Int. Cl.[5] ..... A47G 9/02

[52] U.S. Cl. ..... 5/497; 5/499

[58] Field of Search ..... 5/494–499

[56] References Cited

U.S. PATENT DOCUMENTS

| | | | |
|---|---|---|---|
| 2,162,755 | 6/1939 | Shaver . | |
| 2,195,309 | 3/1940 | Shaver . | |
| 2,454,463 | 11/1948 | Kromer et al. | 5/497 |
| 2,598,141 | 5/1952 | Simpson | 5/497 |
| 2,624,893 | 1/1953 | Harris . | |
| 2,637,049 | 5/1953 | Kromer et al. | 5/497 |
| 2,942,280 | 6/1960 | May, Jr. | 5/497 |
| 2,994,094 | 8/1961 | Hester | 5/497 |
| 3,114,156 | 12/1963 | Cobb | 5/497 |
| 3,273,175 | 9/1966 | Anderson et al. | 5/497 |
| 3,996,633 | 1/1976 | Burke . | |
| 4,723,330 | 2/1988 | Kellogg . | |

OTHER PUBLICATIONS

Sales Pamphlet from Delta Manufacturing of Louisville, Kentucky.

Kimlor Sales Literature (2) pages.

*Primary Examiner*—Michael F. Trettel

*Attorney, Agent, or Firm*—Fliesler, Dubb, Meyer & Lovejoy

[57] ABSTRACT

A bed sheet 10 is comprised of a first panel 14 with at least one corner defined by a first highly stretchable insert 34 and a pocket defined by a second highly stretchable insert 50 in cooperation with the first highly stretchable insert 34. The fitted bed sheet 10 is capable of fitting the form of a conventional innerspring mattress and also a waterbed mattress for any given mattress size classification.

10 Claims, 2 Drawing Sheets

FITTED BED SHEET WITH HIGHLY ELASTICIZED CORNER AND MATTRESS-RETENTION POCKET

FIELD OF THE INVENTION

The present invention is related to form-fitted bed sheets for matresses.

BACKGROUND OF THE INVENTION

With the advent of the waterbed mattress, conventional designs for form-fitted bed sheets which securely cover a mattress has been modified, in order to accommodate the more loose form of a waterbed mattress in comparison to the more rigid form of an innerspring mattress. Such construction has required either a corner pocket panel or an elongated head or foot panel which is comprised of an elasticized material such as, for example, tricot. The pocket corner or panel fits underneath the sleeping surface of the waterbed and prevents the form-fitted sheet from coming loose from the waterbed mattress.

It is convention in the industry that waterbed mattresses and innerspring mattresses for the same size classification (e.g., king size, queen size) are of different dimensions. For example with a king size mattress classification, a standard innerspring mattress is generally 76 inches wide and 80 inches long and 6 or more inches thick. In comparison, a king size waterbed mattress is generally 72 inches wide and 84 inches long. Thus, in order for retailers to sell to both of these markets, there is a requirement that they carry two distinct types of bedding, one to satisfy the dimensional and form requirements of a waterbed and one to satisfy the dimensional and form requirements of an innerspring mattress. Given the fact that there are a number of size classifications for mattresses, the amount of inventory that a retailer has to carry is substantial.

There are several prior art references which use wedge inserts and corners designed into fitted bed sheets. For example, Shaver, U.S. Pat. No. 2,162,755, teaches a fitted sheet which has a triangular gusset made of material which is somewhat heavier than the material from which the sheet itself is made. The gusset can accommodate a certain amount of pulling without tearing and can be comprised of elastic material, knitted fabric or the like. Such a gusset as described in this patent does not allow the bed sheet to conform to waterbed and innerspring mattresses which can have vastly different dimensions for the same size classification.

The Harris patent, U.S. Pat. No. 2,624,893 discloses a mattress covering which has corners comprised of a flat knit material having spaced elastic threads inserted therein. The corner inserts are triangular in shape. The pocket portion formed under the mattress would not hold the sheet onto a waterbed mattress and the material contemplated by Harris would not have sufficient stretchability to cover the various dimensions for any size classification for waterbed and innerspring mattresses.

Accordingly, there is a need to provide a design for a single fitted sheet which will accommodate, for any given size classification, the different dimensions and form requirements of a waterbed mattress as well as an innerspring mattress in order to reduce the retailer's inventory requirements.

SUMMARY OF THE INVENTION

The present invention is directed to overcoming the disadvantages of the prior art in solving the above problem.

The present invention is directed to an improved fitted bed sheet capable of accommodating both the various styles and shapes of a conventional innerspring mattress and of a waterbed mattress for any given size classification. The innerspring mattress and the waterbed mattress both have a sleeping surface, at least one corner, and a mattress support contact surface which is located generally below and spaced from the sleeping surface. The mattress support contact surface contacts the frame or other support for the mattress and is substantially coextensive with the sleeping surface.

The improved fitted bed sheet comprises a first panel for covering and extending past the sleeping surface of the mattress. The improved fitted bed sheet further includes a first highly stretchable insert seamed to the first panel in order to define a sheet corner that fits over the corner the mattress.

The improved fitted bed sheet further includes a second highly stretchable insert seamed to at least the first highly stretchable insert in order to form, with the first highly stretchable insert, a pocket for retention of the first panel on the mattress with the second highly stretchable insert positioned adjacent to the mattress support contact surface.

Accordingly with such an arrangement, the improved fitted bed sheet provides corner pockets to ensure that the fitted bed sheet is retained on a waterbed mattress and in addition provides that the pocket and also the corner insert is comprised of highly stretchable material so that the fitted bed sheet can accommodate the size and dimensional requirements of the waterbed mattress in addition to a conventional innerspring mattress.

The improved fitted bed sheet further includes the first highly stretchable insert being triangular in shape and the second high stretchable insert being triangular in shape.

The improved fitted bed sheet additionally includes the first panel having at least first and second edges with the first and second edges joined to a diagonal corner edge of the first panel. The first highly stretchable insert is seamed to the diagonal corner edge in order to define the sheet corner that fits over the corner of the mattress.

In another aspect of the invention, the second highly stretchable insert of the fitted bed sheet is triangular in shape and includes fourth, fifth and sixth sides with the fourth and fifth sides of the second insert seamed to a third side of the first insert in order to form the pocket with the first insert. Such seaming is required to ensure that the pocket holds the sheet to the waterbed mattress.

In yet another aspect of the invention, the first highly stretchable insert including a material which can stretch a minimum of one and a half of an original dimension of the material and a second highly stretchable insert comprises a material which can stretch a minimum of one and a half times the original dimension of the material.

DETAILED DESCRIPTION OF THE PREFERRED EMBODIMENT

Figure 1:
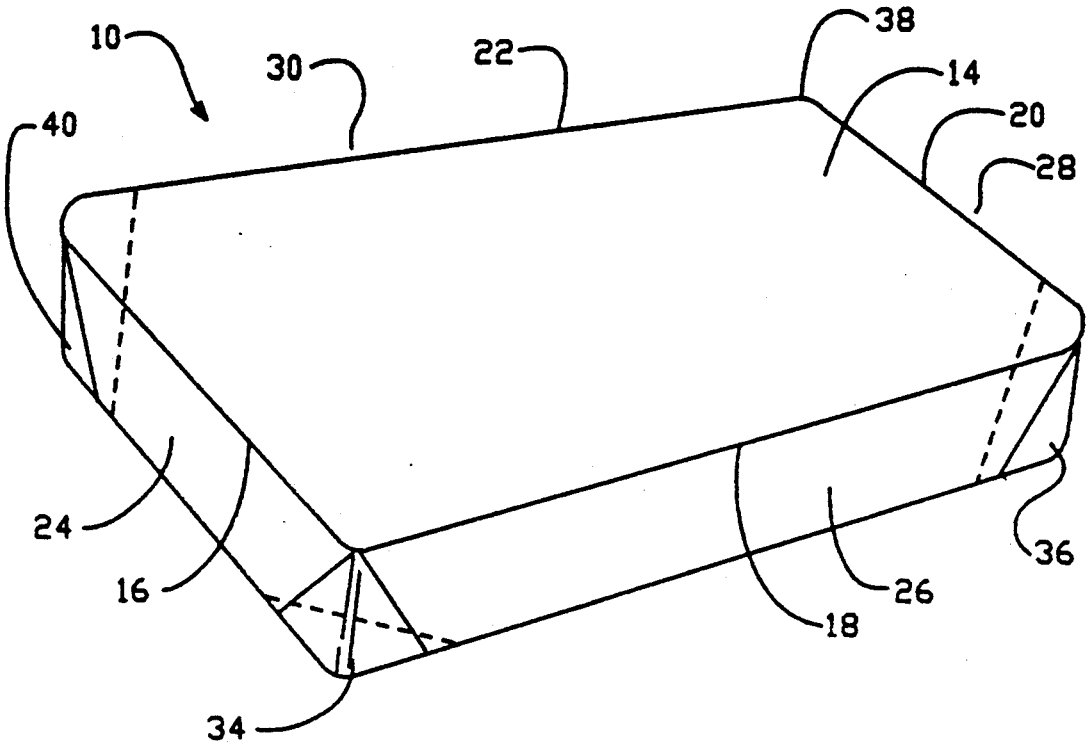
FIG. 1 depicts a top perspective view of an embodiment of the invention.

With reference to the figures and in particular to FIG. 1, a preferred embodiment of the improved fitted bed sheet 10 of the invention is depicted. The bed sheet 10 is depicted fitted onto a mattress 12. The bed sheet 10 includes a top panel 14. The top panel 14 includes edges 16, 18, 20, 22. Dependent from the top panel are side panels 24, 26, 28, 30. These side panels 24, 26, 28, and 30 depend downwardly to cover the sides of the mattress. It is to be understood that in a preferred embodiment, that the top panel and the side panels define a single continuous bed sheet 10 without any seam as is evident from a view of FIG. 3. That is to say that the side panels are not separate pieces of material which are then sewn onto the top panel, but that the top panel and side panels are defined by a single piece of material. The adjacent side panel, such as adjacent side panels 24 and 26 are seamed or sewn to a highly stretchable corner insert 34. Similarly, the other adjacent sides are seamed or sewn to highly stretchable corner inserts 36, 38 and 40. In a preferred embodiment, the corner inserts 34, 36, 38 and 40 are substantially triangular shaped with a corner of the triangular shape meeting, for example, where edge 16 meets edge 18 and the triangular shape therefrom extending downwardly and outwardly to, for example, base 42 of the corner insert 34.

The other corner inserts 36, 38 and 40 include similar bases 44, 46, and 48 respectively.

Figure 2:
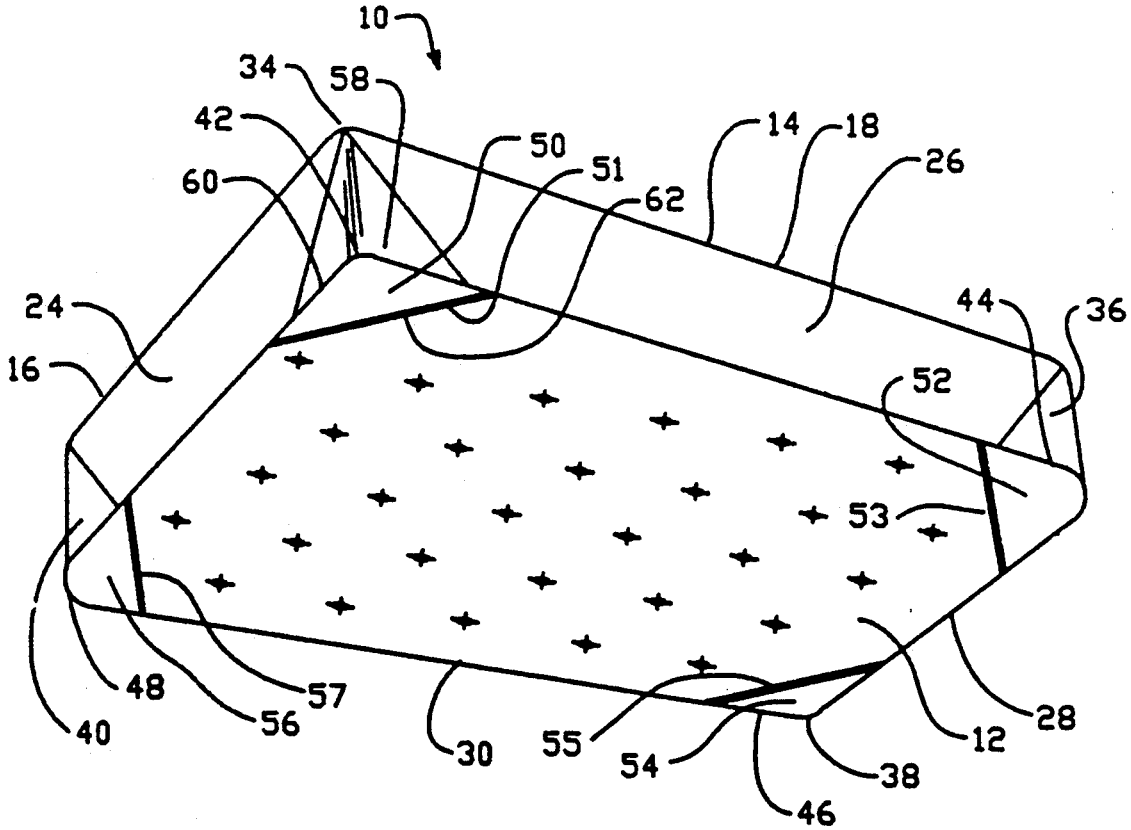
FIG. 2 depicts a bottom perspective view of the embodiment of the invention of FIG. 1.

The bed sheet 10 of the invention further includes pocket inserts 50, 52, 54 and 56 which are comprised of highly stretchable material and in a preferred embodiment are provided in a triangular shape. These pocket inserts are sewn or seamed to the bases 42, 44, 46 and 48 respectively of the corner inserts, as can be seen in FIGS. 1 and 2. By way of example, pocket insert 50, includes edges 58, 60, and 62. Edges 58 and 60 are sewn or stitched to the base 42 of the corner insert 34. As shown in the embodiment, in addition, a portion of the edges 58, 62 is stitched or sewn to the side panels 24 and 26. Furthermore, in a preferred embodiment, elastic strips 51, 53, 55 and 57 are sewn into the free edges, such as edge 62 of the pocket inserts.

Figure 3:
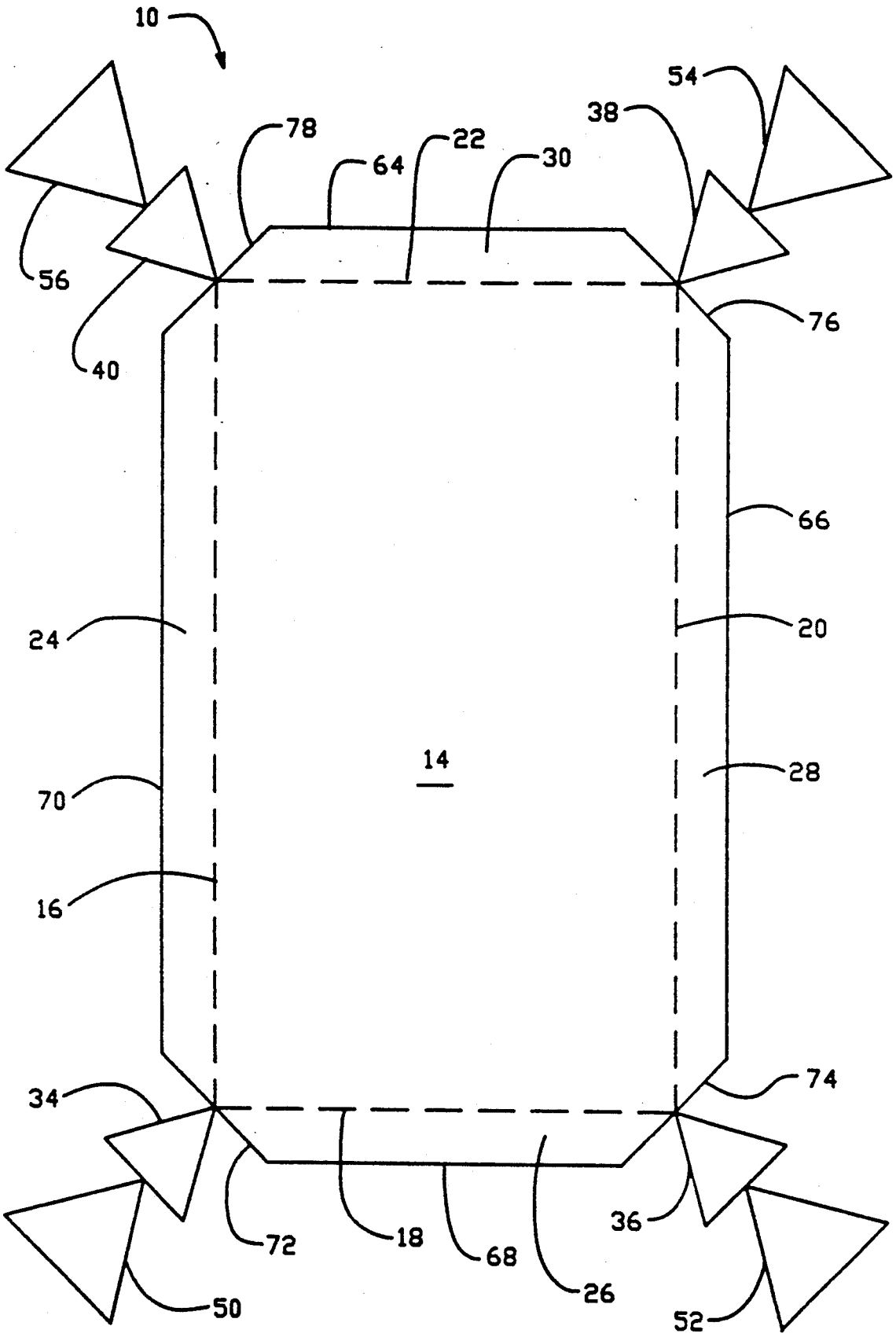
FIG. 3 depicts a cutout layout showing the shapes of the materials to be cut prior to seaming together such materials to form the sheet of the invention as depicted in FIGS. 1 and 2.

FIG. 3 shows a layout for the material which must be laid out and cut prior to the stitching of the material together to form the fitted bed sheet 10 as depicted in FIGS. 1 and 2. It is evident from this layout that the corner inserts 34, 36, 38 and 40 and the pocket inserts 50, 52, 54 and 56 are triangular in shape. Further, it is evident that the edges 64, 66, 68 and 70 of the side panels 24, 26, 28, and 30 respectively are joined by diagonal edges 72, 74, 76 and 78.

In a preferred embodiment, the bed sheet 10 itself is made of a traditional material such as, for example cotton, with the corner inserts and pocket inserts being made of a highly stretchable material which is stretchable at a minimum about one and half times the original length of the material. In a preferred embodiment, the corner insert and pocket insert are comprised Spandix ® which in itself has a formulation of, for example, 88% nylon and 12% lycra. In a preferred embodiment, the Spandix ® is stretchable in one direction to an additional 200% of its original length and in a perpendicular direction is stretchable to an additional 70% of its original length.

INDUSTRIAL APPLICABILITY

From the above, it can be seen that the present invention provides for a single fitted bed sheet which has both the flexibility of fitting the length and width of an innerspring mattress as well the length and width of a waterbed mattress for a certain size classification while accommodating the various height requirements of these two mattress. In addition the bed sheet has the necessary structure to be securely fitted to the waterbed mattress and not be dislocated due to any movement or motion of the waterbed mattress.

We claim:

1. An improved fitted bed sheet capable of accommodating both the various styles and shapes of a conventional innerspring mattress and a waterbed mattress for any given size classification, which innerspring and waterbed mattress has a sleeping surface, at least one corner, and a mattress support contact surface located spaced from and substantially coextensive with the sleeping surface, comprising:

a first panel for covering and extending past the sleeping surface of the mattress;

a first highly stretchable insert seamed to the first panel in order to define a sheet corner that fits over the corner of the mattress;

a second highly stretchable insert seamed to at least the first highly stretchable insert in order to form with the first highly stretchable insert a pocket for retention of the first panel on the mattress with the second highly stretchable insert positioned adjacent to the mattress support contact surface.

2. The improved fitted bed sheet of claim 1 wherein:

said first highly stretchable insert is triangular in shape; and said second highly stretchable insert is triangular in shape.

3. The improved fitted bed sheet of claim 1 wherein:

said first panel has at least first and second edges, which first and second edges are joined to a diagonal corner edge;

wherein said first highly stretchable insert is seamed to the diagonal corner edge in order to define said sheet corner that fits over the corner of the mattress.

4. The improved fitted bed sheet of claim 3 wherein:

said first highly stretchable insert is triangular in shape with first, second and third edges and with the first and the second edges of the first insert seamed to the diagonal corner edge in order to form the corner of the sheet corner.

5. The improved fitted bed sheet of claim 4 wherein:

said second highly stretchable insert is triangular in shape with fourth, fifth and sixth edges, and with the fourth and fifth edges of the second insert seamed to the third edge of the first insert in order to form with the pocket.

6. The improved fitted bed sheet of claim 1 wherein:

said first highly stretchable insert is comprised of a material that can stretch a minimum of one and one half times an original dimension of the material; and said second highly stretchable insert is comprised of a material that can stretch a minimum of one and one half times an original dimension of the material.

7. An improved fitted bed sheet capable of accommodating both the various styles and shapes of a conventional innerspring mattress and a waterbed mattress for any given size classification comprising:

a first panel having first and second edges which meet at a first panel corner;

a first side panel dependant from said first edge;

a second side panel dependant from said second edge;

said first side panel defining a first corner edge which extends from the first panel corner;

said second side panel defining a second corner edge which extends from the first panel corner;

said first corner edge and said second corner edge joined in order to define a side corner;

a highly stretchable pocket panel seamed to the first side panel, and to the second side panel adjacent the side corner;

wherein said first side panel adjacent to the first corner edge is comprised of a highly stretchable material;

wherein said second side panel adjacent to the second corner edge is comprised of a highly stretchable material; and wherein with said pocket panel and said first and second side panels, the side corner is expandable in order to allow the bed sheet to accommodate the various shapes and styles of mattresses within the same size classification.

8. The improved fitted bed sheet of claim 7:

wherein the stretchable material of the first side panel is substantially shaped as a first triangle with one edge of the first triangle being colinear with the side corner; and wherein the stretchable material of the second side panel is substantially shaped as a second triangle with one edge of the second triangle being colinear with the side corner; and wherein said elastic pocket panel is shaped as a triangle.

9. The improved fitted bed sheet of claim 8:

wherein said first side panel has a first side panel edge which is substantially parallel to and spaced from the first edge of the first panel;

wherein said second side panel has a second side panel edge which is substantially parallel to and spaced from the second edge of the first panel;

wherein said first triangle has another edge which is colinear with the first side panel edge; and wherein said second triangle has another edge which is colinear with the second side panel edge.

10. The improved fitted bed sheet of claim 7 wherein:

said panel pocket and the stretchable material of the first side panel and the second side panel can stretch a minimum of one and one half times an original dimension.

* * * * *